United States Patent [19]

Tanikawa et al.

[11] Patent Number: 4,891,161

[45] Date of Patent: Jan. 2, 1990

[54] COLD ROLLING MILL LUBRICANT

[75] Inventors: Keiichi Tanikawa, Yokohama; Yuji Fujioka; Yuzo Higaki, both of Tokyo; Hiroyuki Goto, Yokohama, all of Japan

[73] Assignees: Nisshin Oil Mills, Ltd.; Nippon Steel Corp., both of Japan

[21] Appl. No.: 832,179

[22] Filed: Feb. 24, 1986

[30] Foreign Application Priority Data

| | | | |
|---|---|---|---|
| Feb. 27, 1985 | [JP] | Japan | 60-36645 |
| Feb. 27, 1985 | [JP] | Japan | 60-36646 |
| Apr. 9, 1985 | [JP] | Japan | 60-74787 |
| Apr. 9, 1985 | [JP] | Japan | 60-74788 |

[51] Int. Cl.[4] ..... C10M 105/18; C10M 105/34

[52] U.S. Cl. ..... 252/56 S; 252/52 A

[58] Field of Search ..... 252/56 S, 56 R, 52 A

[56] References Cited

U.S. PATENT DOCUMENTS

| | | | |
|---|---|---|---|
| 2,723,286 | 11/1955 | Young et al. | 252/56 S |
| 3,130,159 | 4/1964 | Stedt | 252/31 |
| 3,923,671 | 12/1975 | Knepp | 252/56 S |
| 3,945,930 | 3/1976 | Sugiyama et al. | 252/56 S |
| 4,108,785 | 8/1978 | Sturwold | 252/56 S X |
| 4,151,099 | 4/1979 | Nassry et al. | 252/56 S |
| 4,175,047 | 11/1979 | Schick et al. | 252/56 S |
| 4,440,660 | 4/1984 | van Rejs et al. | 252/56 S |
| 4,724,100 | 2/1988 | Gilbert | 260/410.9 N |

FOREIGN PATENT DOCUMENTS

| | | |
|---|---|---|
| 839073 | 6/1960 | United Kingdom . |
| 1486197 | 9/1977 | United Kingdom . |

OTHER PUBLICATIONS

Communication from European Patent Office dated Dec. 4, 1986–European Search Report for Appl. No. EP 86 10 2534.

*Primary Examiner*—Ferris H. Lander

*Attorney, Agent, or Firm*—Bacon & Thomas

[57] ABSTRACT

A cold rolling mill lubricant for steel sheets, contains a monoester oil represented by general formula (A):

$$R^1COO-(R^2-O)_n-R^3$$

(Wherein $R^1$ is an alkyl, alkenyl, hydroxyalkyl, or hydroxyalkenyl group having 7 or more carbon atoms, $R^2$ is an alkylene group, $R^3$ is an alkyl or phenyl group, and n is an integer of 1 to 5), and/or a diester oil represented by general formula (B):

$$R^4-\overset{\overset{\displaystyle C}{\|}}{C}-O(R^5-O)_m-\overset{\overset{\displaystyle C}{\|}}{C}-R^6$$

(wherein each $R^4$ or $R^6$ is independently an alkyl, alkenyl, hydroxyalkyl or hydroxyalkenyl group having 5 or more carbon atoms, $R^5$ is an alkylene group having 2 to 4 carbon atoms, and m is an integer of 1 or more).

11 Claims, No Drawings

COLD ROLLING MILL LUBRICANT

BACKGROUND OF THE INVENTION

1. Field of the Invention

The present invention relates to a cold rolling mill lubricant for steel sheets or plates and, more particularly, to a cold rolling mill lubricant having excellent lubricating and mill clean performance.

2. Description of the prior Art

Cold rolling mill lubricants used in cold rolling steel sheets or plates are roughly grouped into those containing, as a base oil, animal or plant oils having the triglyceride structure (e.g., beef tallow, hog fat, palm oil, or coconut oil) and into those containing mineral oils as a base oil. With recent trends of conservation in natural and artificial resources and improvements in productivity, high rolling reduction rolling and high-speed rolling are more frequently performed. Lubricants are therefore required of increasingly high performance such as mill clean performance (i.e., when the lubricant becomes attached to a steel sheet and the steel sheet is annealed without removing it, the thermal decomposition product of the lubricant does not remain on the sheet and the lubricant does not therefore contaminate the sheet surface).

Animal or plant oil-based lubricants can be conveniently used for high rolling reduction rolling or high-speed rolling. However, if the oil content remaining on a cold rolled steel sheet is left unremoved and the sheet is annealed, the sheet surface is contaminated with the residue of the lubricant. In other words, although oils having the triglyceride structure have excellent lubrication performance, they have poor mill clean performance.

Mineral oil-based lubricants have excellent mill clean performance but cannot provide satisfactory lubrication performance in high rolling reduction rolling or high-speed rolling. In order to improve the lubrication performance of mineral oil-based lubricants, oiliness improvers such as animal or plant oils or fatty acids (e.g., caprylic acid, lauric acid, myristic acid, stearic acid, oleic acid, or linolic acid), or esters (e.g., monoester, diester or polyolester containing trimethylol propane, pentaerythrythol, 2-ethylhexyl alcohol as an alcohol component) as described in Yukagaku, Vol. 11, pp. 695 to 706 (1973). However, the addition content of such an oiliness improver must be adjusted to fall within a narrow range, and upon such difficult control satisfactory results are not still obtained.

Although proposals have been made in order to provide cold rolling mill lubricants having excellent lubrication and mill clean performance as per Japanese Patent Disclosure Nos. 56-135600 or 59-80498, satisfactory results have not been obtained so far.

SUMMARY OF THE INVENTION

It is, therefore, an object of the present invention to provide a cold rolling mill lubricant which can provide excellent lubrication performance in high-speed milling or high rolling reduction rolling and can also provide excellent mill clean performance.

According to the present invention, there is provided a cold rolling mill lubricant comprising at least one ester oil selected from the group consisting of a monoester oil represented by general formula (A):

$$R^1COO-(R^2-O)_n-R^3$$

(wherein $R^1$ is an alkyl, alkenyl, hydroxyalkyl or hydroxyalkenyl group having 7 or more carbon atoms; $R^2$ is an alkylene group; $R^3$ is an alkyl or phenyl group; and n is an integer of 1 to 5); and a diester oil represented by general formula (B):

$$R^4-\overset{\overset{\displaystyle O}{\|}}{C}-O(R^5-O)_m-\overset{\overset{\displaystyle O}{\|}}{C}-R^6$$

(wherein each $R^4$ or $R^6$ is independently an alkyl, alkenyl, hydroxyalkyl or hydroxyalkenyl group having 5 or more carbon atoms; $R^5$ is an alkylene group having 2 to 4 carbon atoms; and m is an integer of 1 or more).

The lubricant of the present invention may further contain an oil of roughy fish, a hydrogenated derivative thereof and/or a hydrolyzate thereof (higher fatty acid or higher alcohol).

DETAILED DESCRIPTION OF THE PREFERRED EMBODIMENTS

As described above, a cold rolling mill lubricant according to the present invention contains a monoester oil represented by general formula:

$$R^1COO-(R^2-O)_n-R^3 \quad (A)$$

and/or a diester oil represented by general formula:

$$R^4-\overset{\overset{\displaystyle O}{\|}}{C}-O(R^5-O)_m-\overset{\overset{\displaystyle O}{\|}}{C}-R^6 \quad (B)$$

In general formula (A), $R^1$ is an alkyl, alkenyl, hydroxyalkyl or hydroxyalkenyl group having 7 or more carbon atoms. If the number of carbon atoms of $R^1$ is less than 7, the lubrication of the corresponding ester is not improved much. The upper limit of the number of carbon atoms of $R^1$ is not particularly set. However, in view of availability of raw material fatty acids, the number of carbon atoms of $R^1$ is preferably 29 or less.

$R^2$ is an alkylene group and preferably has 2 to 4 carbon atoms. Examples of such groups include ethylene, propylene, isopropylene, butylene, and isobutylene groups.

$R^3$ is an alkyl or phenyl group. When $R^3$ is an alkyl group, it preferably has 1 to 8 carbon atoms. Examples of such alkyl groups include methyl, ethyl, propyl, isopropyl, butyl, isobutyl, pentyl, isopentyl, hexyl, isohexyl, heptyl, isoheptyl, octyl or isooctyl group.

In formula (A) above, n is an integer of 1 to 5. When n is 6 or more, the corresponding ester has too large a molecular weight. Then, although the rolling lubrication performance is improved, mill clean performance is degraded.

A monoester oil represented by formula (A) is a monoester product between a fatty acid represented by formula:

$$R^1-COOH \quad (I)$$

(where $R^1$ has the same meaning as above) and a glycol monoether represented by formula:

$$HO-(R^2O)_n-R^3 \quad (II)$$

(where $R^2$, $R^3$ and n have the same meanings as above).

Examples of the fatty acids represented by formula (I) include straight chain fatty acids such as octylic acid, decanoic acid, lauric acid, myristic acid, palmitic acid, stearic acid, arachic acid, behenic acid, montanic acid, palmitoleic acid, oleic acid, erucic acid, ricinoleic acid, or 12-hydroxy stearic acid; and side chain fatty acids such as isooctylic acid, isodecanoic acid, isolauric acid, isomyristic acid, isopalmitic acid, isostearic acid, or isoarachic acid.

Examples of the glycol monoethers represented by general formula (II) include ethylene glycol monomethyl ether, ethylene glycol monoethyl ether, ethylene glycol monopropyl ether, ethylene glycol monoisopropyl ether, ethylene glycol monobutyl ether, ethylene glycol monoisobutyl ether, ethylene glycol monohexyl ether, ethylene glycol monophenyl ether, diethylene glycol monomethyl ether, diethylene glycol monoethyl ether, diethylene glycol monopropyl ether, diethylene glycol monoisopropyl ether, diethylene glycol monobutyl ether, diethylene glycol monoisobutyl ether, diethylene glycol monohexyl ether, triethylene glycol monomethyl ether, triethylene glycol monobutyl ether, propylene glycol monomethyl ether, propylene glycol monopropyl ether, and dipropylene glycol monomethyl ether.

A fatty acid represented by general formula (I) and a glycol monoether represented by general formula (II) react in accordance with a known esterification reaction. For example, the fatty acid and the glycol monoether are reacted in a molar ratio of about 1.0:1.1 in an inert atmosphere such as a nitrogen atmosphere at 150° to 230° C. A catalyst such as sulfuric acid or paratoluene sulfonic acid is added in an amount of 0.05 to 0.5% by weight of the total weight of the two substances to react. The reaction is effected for 3 to 10 hours. The reaction is conveniently performed in an organic solvent such as xylene. An excess amount of glycol monoether can be used as a solvent.

The ester can be prepared in another method such as an acid chloride method. Therefore, it is not to be understood that the present invention is limited by the esterification method used.

In general formula (B) above, $R^4$ and $R^6$ are independently an alkyl, alkenyl, hydroxyalkyl or hydroxyalkenyl group having 5 or more carbon atoms. When the number of carbon atoms in $R^4$ or $R^6$ is less than 5, the corresponding ester does not provide good lubrication performance. The upper limit of the carbon atoms of $R^4$ or $R^6$ is not particularly limited. However, from the viewpoint of availability of the raw material fatty acids, the number of carbon atoms in $R^4$ or $R^6$ is preferably 29 or less.

$R^5$ is an alkylene group having 2 to 4 carbon atoms, such as ethylene, propylene, isopropylene, butylene, or isobutylene group.

In general formula (B), m is an integer of 1 or more. When the value of m is too large, the molecular weight of the lubricant is increased and satisfactory mill clean performance is not obtained. In addition, the lubricant obtained becomes a solid and cannot be singly used as a cold rolling mill lubricant. Even if such a solid lubricant is mixed with another base oil, satisfactory mill clean performance cannot be obtained. Therefore, m is preferably 30 or less and more preferably 20 or less.

An ester oil represented by general formula (B) is a diester product between a fatty acid represented by formula:

$$R—COOH \quad (III)$$

(where R is $R^4$ or $R^6$) and a glycol represented by :

$$HO—(R^5O)_m—H \quad (IV)$$

(where $R^5$ and m have the same meanings as above).

Examples of the fatty acids represented by general formula (III) include straight chain fatty acids such as hexanoic acid, octylic acid, nonanoic acid, decanoic acid, lauric acid, myristic acid, palmitic acid, stearic acid, arachic acid, behenic acid, montanic acid, palmitoleic acid, oleic acid, erucic acid, ricinoleic acid, or 12-hydroxy stearic acid; and side chain fatty acids such as isooctylic acid, isodecanoic acid, isolauric acid, isomyristic acid, isopalmitic acid, isostearic acid, and isoarachic acid.

Examples of the glycols represented by general formula (IV) include ethylene glycol, diethylene glycol, polyethylene glycol, propylene glycol, isopropylene glycol, dipropylene glycol, diisopropylene glycol, polypropylene glycol, polyisopropylene glycol, butylene glycol, isobutylene glycol, dibutylene glycol, diisobutylene glycol, polybutylene glycol, and polyisobutylene glycol.

The esterification reaction of a fatty acid represented by general formula (III) and a glycol represented by general formula (IV) is performed under the same manufacturing conditions as for an ester represented by general formula (A) except that the reactants are reacted in a molar ratio of about 2:1.

The esters represented by general formulas (A) and (B) both have excellent lubrication and mill clean performance as cold rolling mi lubricants for steel sheets. However, an oil extracted from roughy fish, a hydrogenated derivative thereof and/or a hydrolyzate thereof may be added.

Roughy fish used in the present invention are orange fish called roughy having body lengths of 30 to 40 cm living in deep sea around Cape Town, south Australia, and the New Zealand. These fish are formally called Hoplostethus atlanticus, H. mediterraneits, H. gilchristi, and H. intermedius which are respectively called saw belly fish, sand paper fish, and orange roughy in English.

The oil extracted from these fish (to be referred to as roughy oil hereinafter) is orange in color and has a composition as shown in Table 1. As can be seen from Table 1, the roughy oil has wax ester as a man component. The wax ester mainly consists of a monoester which, in turn, consists of alcohol and a fatty acid of monoene having one double bond and 18 to 24 carbon atoms.

As can be seen from the composition, the roughy oil does not have the triglyceride structure unlike animal or plant oils but is a wax ester consisting of an alcohol and a fatty acid of monoene. The roughy oil has a low pour point and has excellent workability and thermal stability when compared with animal and plant oils generally used in liquid forms at ambient temperature.

TABLE 1

| Composition of Roughy Oil | |
|---|---|
| Wax ester (monoester) | 95.0 (%) |
| Triacylglycerol | 3.0 |
| Cholesterol/alcohol | 1.0 |
| Phospholipid | 1.0 |

Upon hydrogeneration, the roughy oil used herein has no fish-like order, and improved lubrication and mill clean performance when compared with unhydrogenerated roughy oil. The roughy oil used herein can be hydrogenated as needed. However, when the degree of hydrogenation exceeds 90% or more, the resultant lubricant becomes a solid at ambient temperature, which can be used as an additive but cannot be singly used as a lubricant. Therefore, when the roughy oil is used in a lubricant, the degree of hydrogenation is preferably 5 to 89%. The acid, saponification and iodine values of roughy oil compositions having different hydrogen contents are shown in Table 2 below.

TABLE 2

| Degree of Hydrogenation | Acid value | Specification value | Iodine value |
|---|---|---|---|
| 0% | 0.1 | 110 | 87 |
| 20% | 0.1 | 106 | 70 |
| 50% | 0.1 | 104 | 34 |
| 85% | 0.2 | 103 | 10 |
| 98% | 0.2 | 100 | 2 |

When the roughy oil is subjected to hydrolysis by saponification hydrolysis or lipase decomposition, a higher fatty acid or a higher alcohol is obtained. Such a higher fatty acid or alcohol can be used as a lubricant. Table 3 below shows the compositions of the main higher fatty acids and alcohols contained in the wax ester of the roughy oil.

TABLE 3

| Component No. of C atoms: No. of double bonds | Fatty acid (%) | Alcohol (%) |
|---|---|---|
| 14:0 | 1.3 | 1.0 |
| 16:0 | 1.2 | 7.2 |
| 18:0 | 0.4 | 8.2 |
| 14:1 | 0.4 | 0.1 |
| 16:1 | 11.8 | 0.1 |
| 18:1 | 57.0 | 33.4 |
| 20:1 | 16.5 | 30.8 |
| 22:1 | 7.8 | 15.1 |
| 24:1 | trace | 4.6 |

The lubricant composition of the present invention can contain the roughy oil, a hydrogenated derivative thereof and/or a hydrolyzate thereof (higher fatty acid or alcohol) in an amount of 1 to 95% by weight, preferably 20 to 70% by weight, and an ester represented by general formula (A) and/or (B) in an amount of 1 to 95% by weight, preferably 20 to 70% by weight.

The ester oil represented by general formula (A) or (B) or a mixture thereof with roughy oil-based lubricant, i.e., the roughy oil, a hydride thereof or a hydrolyzate thereof, can be singly used as a cold rolling mill lubricant for steel sheets, or can be added to another base oil such as an animal or plant oil or a mineral oil. When added to another base oil, the ester oil or a mixture thereof with the roughy oil-based lubricant can be added in an amount of 1% by weight, preferably 5% by weight or more, and more preferably 20% by weight or more of another base oil. The cold rolling mill lubricant of the present invention can also contain an emulsifier, a fatty acid, an antioxidant, and a corrosion inhibitor normally contained in lubricants in addition to the ester oil of the present invention. The cold rolling mill lubricant according to the present invention can be in the form of an aqueous emulsion.

EXAMPLES 1 TO 10

Preparation of Monoester Represented by General Formula

A four-neck flask having a stirrer, a thermometer, a nitrogen gas blowing pipe, and a water separator was charged with 5 moles of stearic acid and 6 moles of ethylene glycol monobutyl ether. 0.1% of sulfuric acid based on the total charge amount was added as a catalyst. The mixture was well stirred in a nitrogen atmosphere at 160° to 230° C. using the excess portion of ethylene glycol monobutyl ether as a reflux solvent until the calculated amount of water was distilled. The reaction time was 6 hours. After the reaction, the reaction product was washed with water to remove the catalyst and the unreacted ethylene glycol monobutyl ether was distilled off. The product was then bleached with an activated clay to provide a yellow liquid ester product. The yield was 91% and the product had an acid value of 0.3 and a saponification value of 145.

Synthetic esters were prepared by the similar method using different types of fatty acid and glycol ester. The properties of the obtained synthetic esters are shown in Table A.

TABLE A

| Example | Fatty acid | Glycol ether $R^2$ | n | $R^3$ | Synthetic ester Name | Saponification value | Acid value | Reference symbol |
|---|---|---|---|---|---|---|---|---|
| 1 | Stearic acid | Ethylene | 1 | Butyl | Ethylene glycol monobutyl | 145 | 0.3 | A |
| 2 | Isooctylic acid | Ethylene | 5 | Isooctyl | Pentaethylene glycol monoisooctyl | 93 | 0.2 | B |
| 3 | Palmitic acid | Isopropylene | 1 | Isopropyl | Propylene glycol monoisopropyl | 164 | 0.9 | C |
| 4 | Stearic acid | Ethylene | 1 | Phenyl | Ethylene glycol monophenyl | 137 | 0.4 | D |
| 5 | Oleic acid | Butylene | 3 | Methyl | Tributylene glycol monomethyl | 110 | 0.3 | E |
| 6 | 12-hydroxy stearic acid | Ethylene | 1 | Butyl | Ethylene glycol monobutyl | 133 | 1.0 | F |
| 7 | Behenic acid | Ethylene | 1 | Butyl | Ethylene glycol monobutyl | 131 | 0.5 | G |
| 8 | Palmitic acid 35 wt % Stearic acid 65 wt % | Ethylene | 3 | Methyl | Triethylene glycol monomethyl | 135 | 0.7 | H |
| 9 | Isostearic acid* | Ethylene | 2 | Butyl | Diethylene glycol monobutyl | 133 | 0.2 | I |

TABLE A-continued

| Example | Fatty acid | Glycol ether $R^2$ | n | $R^3$ | Synthetic ester Name | Saponification value | Acid value | Reference symbol |
|---|---|---|---|---|---|---|---|---|
| 10 | Montanic acid | Ethylene | 1 | Isobutyl | Ethylene glycol monoisobutyl | 103 | 0.3 | J |

*Emery Industries, Inc.

EXAMPLES 11 TO 19

Preparation of Diester Represented by General Formula (B)

A four-neck flask having a stirrer, a thermometer, a nitrogen gas blowing pipe, and a water separator was charged with 2.2 moles of isooctylic acid and 1 mole of polyethylene glycol (average molecular weight: 600). 0.2% of paratoluene sulfonic acid based on the total charge amount was added as a catalyst. The mixture was well stirred in a nitrogen atmosphere at 160° to 230° C. using 5% of xylene based on the total charge amount as a reflux solvent until the calculated amount of water collected in the water separator. The reaction time was 8 hours. After the reaction, the reaction product was washed with water to remove the catalyst and the unreacted isooctylic acid was distilled off at 160° C. and 3 Torr. The product was then bleached with activated clay to provide a yellow liquid ester product. The yield was 88% and the product had an acid value of 0.2 and a saponification value of 123.

Synthetic esters were prepared by the similar method using different types of fatty acid and glycols. The properties of the obtained synthetic esters are shown in Table B.

TABLE B

| Example | Fatty acid | Glycol $R^5$ | Average Molecular weight | Name | Synthetic ester Acid value | Saponification value | Reference symbol |
|---|---|---|---|---|---|---|---|
| 11 | Isooctylic acid | Ethylene | 600 | Polyethylene glycol | 0.5 | 132 | K |
| 12 | Lauric acid | Ethylene | 200 | Polyethylene glycol | 0.3 | 191 | L |
| 13 | Oleic acid | Ethylene | 600 | Polyethylene glycol | 0.5 | 96 | M |
| 14 | Decanoic acid | Ethylene | 600 | Polyethylene glycol | 0.6 | 122 | N |
| 15 | Lauric acid | Iso-propylene | 700 | Polypropylene glycol | 0.8 | 103 | O |
| 16 | Decanoic acid | Iso-propylene | 700 | Polypropylene glycol | 0.8 | 108 | P |
| 17 | Palmitic acid 1* Stearic acid 1 | Iso-propylene | 1000 | Polypropylene glycol | 0.3 | 73 | Q |
| 18 | 12-hydroxy stearic acid | Iso-propylene | 1200 | Polypropylene glycol | 0.4 | 60 | R |
| 19 | Isostearic acid | Butylene | 1200 | Polyethylene glycol | 0.3 | 61 | S |

*Molar ratio

EXAMPLE A

The synthetic ester shown in Table A was singly used as a lubricant and cold running milling and annealing of hot rolled, pickled steel sheets performed.

The lubrication and mill clean performance in cold rolling milling were examined in the following manner.

Hot rolled, pickled steel sheets having a thickness of 2.30 mm were subjected to three cold rolling mill processes to a final thickness of 1.20 mm. After degreasing, the steel sheets were dipped in oil baths of sample lubricants diluted to 5.0% in n-hexane for a predetermined of time. The solvent was evaporated by allowing the sheets to stand to provide the steel sheets in which a uniform amount of lubricant was applied. The steel sheets were then cold rolling milled. The rolling load at a rolling reduction of 45% was measured, and the lubrication performance during rolling was evaluated. The coefficient of friction of each lubricant was determined by a Bowden friction tester (load 1 kg; temperature 100° C.) and the lubrication performance of the lubricant was evaluated.

The mill clean performance of the lubricants was evaluated in the following manner. Each sample lubricant was dripped onto a cold rolling milled steel sheet (80×100×0.8 mm) in an amount corresponding to about 630 mg/m$^2$ through a microsyringe. Another cold rolling milled steel sheet of the same size was stacked on the sheet. After several tens of sheets were stacked in this manner, the stack was bundled with a thin steel belt. The obtained sample was annealed in a small annealing furnace.

Annealing was performed by heating in 120 ml /min of an HNX gas ($H_2$:5%) at a heating rate of 10° C./min to 600° C., keeping the sheet at 600° C. for 1 hour, and then allowing it to cool naturally. A strip of cellophane tape was attached to the sheet surface to sample the surface contaminant which was adhered to a piece of white paper for visual observation. The mill clean performance of the lubricants was thus evaluated.

Table I shows the results of evaluation of the rolling performance with a single-component lubricant, lubrication performance by a Bowden lubricant tester, and mill clean performance.

EXAMPLE B

The same evaluation as in Example A was performed for the lubrication and annealing performance of the lubricant obtained by adding a synthetic ester according to the present invention and an emulsifier, a fatty acid and an antioxidant as additives to a mineral oil or beef tallow used as a base oil for conventional lubricants.

Emulsion rolling was performed in a two-step rolling mill by rolling a material (spcc) 1.2×20×200 mm under conditions of an oil concentration of 3% and a bath temperature of 50° C. The rolling load at a rolling reduction of 40% was measured to evaluate the rolling lubrication performance. As for annealing, several tens of steel sheets rolled with the sample emulsion were stacked and bundled with a thin strip of steel. The stack was annealed in a small annealing furnace. The annealing conditions were the same as those for a single lubricant in Example A. The clean mill performance of the lubricant was evaluated also in the same manner. The obtained results are also shown in Table I.

TABLE I

| | | Single use | | | | | | |
|---|---|---|---|---|---|---|---|---|
| | | Refined beef tallow | Mineral oil | Ester A | Ester BC | Ester E | Ester H | Ester I |
| Rolling lubricant composition | Mineral oil | | | | | | | |
| | Refined beef tallow | | | | | | | |
| | Stearic acid | | | | | | | |
| | Antioxidant[1] | | | | | | | |
| | Emulsifier[2] | | | | | | | |
| lubricating performant | Rolling load ratio[3] | 1.00 | 1.23 | 1.04 | 1.03 | 1.03 | 1.02 | 1.03 |
| | Bowder test[4] | 0.172 | 0.324 | 0.209 | 0.188 | 0.195 | 0.180 | 0.184 |
| Mill clean performance[5] | | x | ◎ | ◎~○ | ◎ | ◎~○ | ◎~○ | ◎ |

| | | Mixture emulsion[6] | | | | | | |
|---|---|---|---|---|---|---|---|---|
| | | Comparative Example 1 | Comparative Example 2 | Ester A | Ester B | Ester D | Ester E | Ester H |
| Rolling lubricant composition | Mineral oil | 40 | 55 | 30 | 25 | 20 | 27 | 18 |
| | Refined beef tallow | 55 | 35 | 15 | 22 | 22 | 15 | 22 |
| | Stearic acid | 2 | 7 | — | — | 5 | 5 | 5 |
| | Antioxidant[1] | 1 | 1 | 1 | 1 | 1 | 1 | 1 |
| | Emulsifier[2] | 2 | 2 | 2 | 2 | 1 | 1 | 1 |
| lubricating performant | Rolling load ratio[3] | 1.00 | 1.02 | 1.03 | 1.02 | 1.02 | 1.03 | 1.01 |
| | Bowder test[4] | | | | | | | |
| Mill clean performance[5] | | Δ | ○~Δ | ◎~○ | ◎ | ◎~○ | ◎ | ◎~○ |

[1]Antioxidant: 2,6-tert-butylphenol
[2]Emulsifier: Polyoxyethylene alkyl phenyl ether (HLB 11.7)
[3]Rolling load ratio: Value with reference to refined beef tallow for simple use and to comparative Example 1 for emulsion
[4]Bowder test (100° C. 1 Kg): Value after 20 sliding movements
[5]Evaluation of mill clean performance: ◎ . . no contamination; ○. . . very slight contamination; Δ . . . contamination observed; x . . . considerable contamination
[6]Symbols A to I represent the same esters as indicated by the same symbols in Table A. Ester concentration in emulsion is 50%. Actually used rolling fluids are emulsions having an oil content of 3%. All units are in % by weight.

EXAMPLE C

Using a diester shown in Table B, the lubrication and mil clean performance was evaluated following the same procedures as in Examples A and B. The obtained results are shown in Table II.

TABLE II

| | | Single use | | | | | |
|---|---|---|---|---|---|---|---|
| | | Refined beef tallow | Mineral oil | Ester K | Ester O | Ester Q | Ester S |
| Rolling lubricant composition | Mineral oil | | | | | | |
| | Refined beef tallow | | | | | | |
| | Stearic acid | | | | | | |
| | Antioxidant[1] | | | | | | |
| | Emulsifier[2] | | | | | | |
| lubricating performant | Rolling load ratio[3] | 1.00 | 1.26 | 0.98 | 0.99 | 0.96 | 0.92 |
| | Bowder test[4] | 0.178 | 0.334 | 0.170 | 0.170 | 0.169 | 0.160 |
| Mill clean performance[5] | | x | ◎ | ◎~○ | ◎~○ | ○ | ○ |

| | | Mixture emulsion[6] | | | | | | |
|---|---|---|---|---|---|---|---|---|
| | | Comparative Example 1 | Comparative Example 2 | Ester K | Ester L | Ester N | Ester P | Ester Q |
| Rolling lubricant | Mineral oil | 40 | 52 | 42 | 37 | 32 | 31.5 | 42 |
| | Refined beef tallow | 55 | 35 | 10 | 10 | 15 | 20 | 5 |
| | Stearic acid | 2 | 10 | — | 5 | 5 | — | 5 |

TABLE II-continued

| | | | | | | | | |
|---|---|---|---|---|---|---|---|---|
| composition | Antioxidant[1] | 1 | 1 | 1 | 1 | 1 | 1 | 1 |
| | Emulsifier[2] | 2 | 2 | 2 | 2 | 2 | 2 | 2 |
| lubricating performant | Rolling load ratio[3] | 1.00 | 1.02 | 0.99 | 1.01 | 0.98 | 0.97 | 0.98 |
| | Bowder test[4] | | | | | | | |
| Mill clean performance[5] | | Δ | ○~Δ | ◎ | ◎ | ◎~○ | ◎~○ | ◎~○ |

*Rolling lubricant composition: % by weight
[1]Antioxidant: 2,6-tert-butyl-4-methylphenol
[2]Emulsifier: Polyoxyethylene alkyl phenyl ether (HLB 11.7)
[3]Rolling load ratio: Value with reference to refined beef tallow for simple use and to comparative Example 1 for emulsion
[4]Bowder test (100° C. 1 Kg): Value after 20 sliding movements
[5]Evaluation of mill clean performance: ◎ . . no contamination; ○. . . very slight contamination; Δ . . . contamination observed; x . . . considerable contamination
[6]Content of synthetic ester (K - Q) is 45%. Actual emulsions have an oil content of 3%

EXAMPLE D

Using a mixture of an ester in Table A and a roughy oil based lubricant, the lubrication and mill clean performance was evaluated following the same procedures as in Examples A and B. The obtained results are shown in Tables III and IV.

TABLE III

| | | Single use[4] | | | | | | | | | | |
|---|---|---|---|---|---|---|---|---|---|---|---|---|
| | | Refined beef tallow | Mineral oil | Roughy oil | Ester A | Ester A | Ester A | Ester D | Ester D | Ester D | Ester H | Ester H |
| Roughy oil *2 | | | | | 60 | — | — | — | — | 60 | 40 | — |
| Roughy oil *3 | | | | | — | — | 50 | 60 | — | — | — | — |
| Roughy oil *4 | | | | | — | 60 | — | — | 50 | — | — | 60 |
| Higher fatty acid | | | | | — | — | 10 | — | — | — | — | — |
| Higher alcohol | | | | | — | — | — | — | 10 | — | 20 | — |
| lubricating performant | Rolling load ratio[1] | 1.00 | 1.26 | 1.03 | 0.981 | 0.965 | 0.976 | 0.970 | 0.968 | 0.975 | 0.985 | 0.968 |
| | Bowder test[2] | 0.175 | 0.330 | 0.180 | 0.167 | 0.160 | 0.172 | 0.165 | 0.170 | 0.174 | 0.175 | 0.171 |
| Mill clean Performance[3] | | x | ◎ | Δ | ◎~○ | ◎ | ◎~○ | ◎ | ◎ | ◎ | ◎ | ◎ |

*1: Hydrogen content 0%
*2: Hydrogen content 20%
*3: Hydrogen content 40%
*4: Hydrogen content 80%
**: Hydrolyzate of roughy oil (composition in Table 4)
[1]Rolling load ratio: Value with reference to refined beef tallow
[2]Bowder test (100° C. 1 Kg): Value after 20 sliding movements
[3]Evaluation of mill clean performance: ◎. . no contamination; ○. . . very slight contamination; Δ . . . contamination observed; x . . . considerable contamination
[4]Symbols C, D and H represent the same esters as indicated by the same symbols in Table A. The ester concentration is 40%.

TABLE IV

| | | Mixture emulsion[5] | | | | | | | |
|---|---|---|---|---|---|---|---|---|---|
| | | Comparative Example 1 | Comparative Example 2 | Ester A | Ester B | Ester D | Ester G | Ester H | Ester I |
| Rolling lubricant composition | Rougly oil *1 | | | 47 | — | — | — | 50 | — |
| | Rougly oil *2 | | | — | — | 45 | 57 | — | — |
| | Rougly oil *3 | | | — | 57 | — | — | — | 47 |
| | Mineral oil | 40 | 65 | 10 | — | 12 | — | 7 | 10 |
| | Refined beef tallow | 52 | 25 | — | — | — | — | — | — |
| | Stearic acid | 5 | 7 | — | — | — | — | — | — |
| | Antioxidant[1] | 1 | 1 | 1 | 1 | 1 | 1 | 1 | 1 |
| | Emulsifier[2] | 2 | 2 | 2 | 2 | 2 | 2 | 2 | 2 |
| lubricating performant (Rolling load ratio)[3] | | 1.00 | 1.10 | 0.98 | 0.91 | 0.98 | 0.92 | 0.96 | 0.92 |
| Mill clean performance[4] | | Δ | ◎~Δ | ◎ | ◎ | ◎ | ◎ | ◎ | ◎ |

*1: Hydrogen content 20%
*2: Hydrogen content 50%
*3: Hydrogen content 85%
[1]Antioxidant: 2,6-tert-butyl-4-methylphenol
[2]Emulsifier: Polyoxyethylene alkyl phenyl ether (HLB 11.7)
[3]Rolling load ratio: Value with reference to comparative Example 1
[4]Evaluation of mill clean performance: ◎. . . no contamination; ○. . . very slight contamination; Δ. . . contamination observed
[5]Symbols A to I represent the same esters as indicated by the same symbols in Table 1. Ester concentration in emulsion is 40%. Actually used rolling fluids are emulsions having an oil content of 6%. All units are in % by weight.
[6]Rolling lubricant composition: Units in % by weight

EXAMPLE E

Using a mixture of a diester in Table B and a roughy oil based lubricant, the lubrication and mill clean performance was evaluated following the same procedures as in Examples A and B. The obtained results are shown in Tables V and VI.

TABLE V

| | | Single use[4] | | | | | | | | | | |
|---|---|---|---|---|---|---|---|---|---|---|---|---|
| | | Refined beef tallow | Mineral oil | Roughy oil *1 | Ester K | Ester K | Ester K | Ester N | Ester N | Ester N | Ester Q | Ester Q |
| Hydrogen added roughy oil *2 | | | | | 50 | — | — | 60 | — | — | 60 | — |
| Hydrogen added rough oil *3 | | | | | — | 60 | — | — | — | 40 | — | — |
| Hydrogen added rough oil *4 | | | | | — | — | 50 | — | 50 | — | — | 50 |
| Higher fatty acid | | | | | 10 | — | — | — | 10 | 20 | — | — |
| Higher alcohol | | | | | — | — | 10 | — | — | — | — | 10 |
| lubricating performant | Rolling load ratio[1] | 1.00 | 1.25 | 1.03 | 0.99 | 0.98 | 0.98 | 0.99 | 0.97 | 0.99 | 1.00 | 0.97 |
| | Bowder test[2] | 0.178 | 0.335 | 0.180 | 0.175 | 0.170 | 0.172 | 0.176 | 0.168 | 0.175 | 0.176 | 0.170 |
| Mill clean performance[3] | | x | ◎ | Δ | ◎ | ◎ | ◎ | ◎ | ◎ | ◎ | ◎~○ | ◎~○ |

*1: Hydrogen content 0%
*2: Hydrogen content 20%
*3: Hydrogen content 40%
*4: Hydrogen content 80%
**Hydrolyzate of roughy oil
[1]Rolling load ratio: Value with reference to refined beef tallow
[2]Bowder test (100° C. 1 Kg): Value after 20 sliding movements
[3]Evaluation of mill clean performance: ◎ . . no contamination; ○ . . very slight contamination; Δ . . . contamination observed; x . . . considerable contamination
[4]Content of synthetic esters (K, N, Q) is 40%.

TABLE VI

| | | Mixture emulsion [5] | | | | | | | |
|---|---|---|---|---|---|---|---|---|---|
| | | Comparative Example 1 | Comparative Example 2 | Ester L | Ester M | Ester O | Ester P | Ester R | Ester S |
| Rolling lubricant composition | Hydrogen added rougly oil *1 | | | 57 | — | — | — | — | 50 |
| | Hydrogen added rougly oil *2 | | | — | 47 | — | — | 45 | — |
| | Hydrogen added rougly oil *3 | | | — | — | 45 | 37 | — | — |
| | Mineral oil | 50 | 60 | — | 10 | 12 | 20 | 12 | 7 |
| | Refined beef tallow | 47 | 20 | — | — | — | — | — | — |
| | Stearic acid | — | 7 | — | — | — | — | — | — |
| | Antioxidant[1] | 1 | 1 | 1 | 1 | 1 | 1 | 1 | 1 |
| | Emulsifier[2] | 2 | 2 | 2 | 2 | 2 | 2 | 2 | 2 |
| lubricating performant (Rolling load ratio)[3] | | 1.00 | 1.12 | 0.998 | 0.99 | 0.98 | 0.98 | 0.98 | 0.98 |
| Mill clean performance[4] | | Δ | ○~Δ | ◎ | ◎ | ◎ | ◎ | ◎~○ | ◎~○ |

*1: Hydrogen content 20%
*2: Hydrogen content 50%
*3: Hydrogen content 85%
[1]Antioxidant: 2,6-tert-butyl-4-methylphenol
[2]Emulsifier: Polyoxyethylene alkyl phenyl ether (HLB 11.7)
[3]Rolling load ratio: Value with reference to comparative Example 1
[4]Evaluation of mill clean performance: ◎ . . no contamination; ○ . . . slight contamination; Δ . . . contamination observed
[5]Content of synthetic esters (L to S) is 40%
*Rolling lubricant composition: Units in % by weight In summary, cold rolling mill lubricants according to the present invention have excellent lubrication and mill clean performance. The lubricants are suitable for high-speed rolling and high rolling reduction rolling for steel sheets. Even if the oil component attached to the steel sheets is unremoved before annealing of the steel sheets, the surfaces of the steel sheets are not contaminated. For this reason, a method of manufacturing cold rolling milled steel sheets by cold rolling milling steel sheets while lubricating the steel sheets with a cold rolling mill lubricant of the present invention, and annealing the sheets without removing attached lubricants is also intended to fall within the scope of the present invention.

What is claimed is:

1. A method of manufacturing cold rolling milled steel sheets which comprises cold rolling milling the steel sheets while lubricating the sheets with a lubricant and annealing the sheets on which the lubricant is attached whereby the annealing is done in the presence of the lubricant; said lubricant being an ester oil represented by the formula:

$R^1COO—(R^2—O)_n—R^3$ wherein $R^1$ is an alkyl, alkenyl, hydroxyalkyl, or hydroxyalkenyl group having 7 or more carbon atoms; $R^2$ is an alkylene group; $R^3$ is an alkyl group having not more than 8 carbon atoms or phenyl group; and n is an integer of 1 to 5 whereby annealing the sheets in the presence of the above defined lubricant results in mill clean performance.

2. The method of claim 1, wherein $R^1$ has up to 29 carbon atoms.

3. The method of claim 1, wherein $R^2$ has 2–4 carbon atoms.

4. The method of claim 1, wherein the ester oil is a reaction product between a fatty acid represented by the formula $R^1COOH$ where $R^1$ has the same meaning as in claim 1 and a glycol monoether represented by the formula $HO—(R^2O)_n—R^3$ where $R^2$, $R^3$ and n have the same meaning as in claim 1.

5. The method of claim 4, wherein the fatty acid is at least one member selected from the group consisting of octylic acid, decanoic acid, lauric acid, myristic acid, palmitic acid, stearic acid, arachic acid, behenic acid, montanic acid, palmitoleic acid, oleic acid, erucic acid, ricinoleic acid, 12-hydroxy stearic acid, isooctylic acid, isodecanoic acid, isolauric acid, isomyristic acid, isopalmitic acid, isostearic acid, and isoarachic acid.

6. The method of claim 5, wherein the glycol monoether is at least one member selected from the group consisting of ethylene glycol monoethyl ether, ethylene glycol monoethyl ether, ethylene glycol monopropyl ether, ethylene glycol monoisopropyl ether, ethylene glycol monobutyl ether, ethylene glycol monoisobutyl ether, ethylene glycol monohexyl ether, ethylene glycol monophenyl either, diethylene glycol monomethyl either, diethylene glycol monoethyl either, diethylene glycol monopropyl ether, diethylene glycol monoisopropyl either, diethylene glycol monobutyl either, diethylene glycol monoisobutyl either, diethylene glycol monohexyl either, triethylene glycol monomethyl either, triethylene glycol monobutyl either, propylene glycol monomethyl either, propylene glycol monopropyl ether, and dipropylene glycol monomethyl ether.

7. The method of claim 1, wherein $R^2$ is ethylene or isopropylene and n is 1 or 2.

8. The method of claim 1, wherein the lubricant further comprises at least one roughly oil-based lubricant selected from the group consisting of an oil selected from roughy fish, a hydrogenated derivative thereof and a hydrolyzate thereof.

9. The method of claim 8, wherein the roughy oil-based lubricant is contained in an amount of 1 to 95% by weight.

10. The method of claim 9, wherein the roughy oil-based lubricant is the hydrogenated derivative.

11. The method of claim 9, wherein the hydrogenated derivative has a degree of hydrogenation of 5 to 89%.

* * * * *